United States Patent [19]

Hendrickson et al.

[11] Patent Number: 4,986,102

[45] Date of Patent: Jan. 22, 1991

[54] ELECTROMAGNETIC DENT REMOVER WITH TAPPED WORK COIL

[75] Inventors: I. Glen Hendrickson; Karl A. Hansen, both of Seattle, Wash.

[73] Assignee: The Boeing Company, Seattle, Wash.

[21] Appl. No.: 355,563

[22] Filed: May 23, 1989

[51] Int. Cl.[5] ..... B21D 26/14

[52] U.S. Cl. ..... 72/56; 72/705

[58] Field of Search ..... 72/56, 705, 707

[56] References Cited

U.S. PATENT DOCUMENTS

| | | |
|---|---|---|
| 2,510,253 | 6/1950 | Reed . |
| 2,605,658 | 8/1952 | Sanchez . |
| 3,126,046 | 3/1964 | Richey . |
| 3,175,383 | 3/1965 | Levine . |
| 3,196,649 | 7/1965 | Furth . |
| 3,621,427 | 11/1971 | Bennon . |
| 3,747,038 | 7/1973 | McGill . |
| 3,825,819 | 7/1974 | Hansen et al. . |
| 3,998,081 | 12/1976 | Hansen et al. . |
| 4,061,007 | 12/1977 | Hansen et al. . |
| 4,116,031 | 9/1978 | Hansen et al. . |
| 4,135,379 | 1/1979 | Hansen et al. . |
| 4,252,008 | 2/1981 | Dibbens . |
| 4,313,151 | 1/1982 | Vranken . |

FOREIGN PATENT DOCUMENTS

| | | |
|---|---|---|
| 29316 | 1/1922 | Denmark . |
| 407999 | 3/1943 | Italy . |

*Primary Examiner*—Lowell A. Larson

*Attorney, Agent, or Firm*—Christensen, O'Connor, Johnson & Kindness

[57] ABSTRACT

An electromagnetic dent remover having a tapped work coil (36) is provided. A first current pulse, $I_S$, is applied to an inner and outer coil (48 and 46) to produce an electromagnetic field that exerts a repelling force on a conductive part (24). A second current pulse, $I_F$, having a polarity opposite that of the $I_S$ current pulse and a rise time shorter than that of the $I_S$ pulse, is applied to the inner coil (48), which collapses the electromagnetic field associated with the inner coil (48) and causes a pulling force to be exerted on the part (24) by the inner coil (48). The work coil (36) is positioned over a dent in the conductive part (24) so that the pulling force produced by the inner coil (48) is concentrated on the dent and pulls the dent from the part (24). Simultaneously, the pulling force is counteracted by the repelling force produced with the outer coil (46). The repelling force stabilizes the part (24) to facilitate the removal of the dent. In addition to stabilizing the part (24), the repelling force created by the outer coil (46) may be used to remove convex deformations (20) of the dent.

26 Claims, 3 Drawing Sheets

+
−
$I_S$
$I_F$
$I_I$
$I_0$
$I_F'$
$I_0'$
t
$t_0$
$t_1$
$t_2$
$t_3$

ELECTROMAGNETIC DENT REMOVER WITH TAPPED WORK COIL

FIELD OF THE INVENTION

This invention relates to devices for removing dents and, more particularly, to devices for removing dents from electrically conductive materials using electromagnetic energy.

BACKGROUND OF THE INVENTION

The effectiveness of electromagnetic dent removers, that is, dent removers that use electromagnetic energy to remove dents from conductive materials, is well known in the prior art. These dent removers are commonly used in the aircraft manufacturing and repair industry as well as in other industries, such as in the automotive industry. One very common use of an electromagnetic dent remover is for the removal of dents from the outer "skin" of assembled aircraft or aircraft parts, such as wing assemblies. The outer skin is usually made of conductive sheet material that is fastened to an internal frame of the aircraft. Once the skin has been fastened to the frame, the inside surface of the skin is, many times, inaccessible. Electromagnetic dent removers are well suited to removing dents from the aircraft skin because they do not require access to the inside surface of the skin.

An electromagnetic dent remover uses an electric coil, commonly referred to as a work coil, to remove a dent. To remove a dent from a conductive part, such as the skin of an aircraft, the work coil is placed on the dented part and positioned over the dent. An electric current is applied to the work coil, which produces an electromagnetic field that penetrates the dented part. In a conventional manner, the electromagnetic field exerts a repelling force on the dented part. While the repelling force is quite strong, it typically is not strong enough to deform the dented part. By properly controlling the electric current applied to the work coil, the electromagnetic field is caused to rapidly collapse. The collapsing electromagnetic field causes the repelling force to reverse, thereby exerting a pulling force on the part. Unlike the repelling force, however, the pulling force is normally strong enough to deform the dented part. Thus, the pulling force is used to pull the dent from the part. An example of such a dent remover is described in U.S. Pat. No. 3,998,081, entitled "Electromagnetic Dent Puller". The disclosure of U.S. Pat. No. 3,998,081, and particularly the portion of the disclosure describing the production and application of electric current to the electromagnetic work coil, is incorporated herein by reference.

It is well known in the prior art that the electromagnetic field should be concentrated at the dent so that adjacent areas of the part will not be deformed when the dent is removed. One successful prior art approach concentrates the electromagnetic field by using a work coil having a stressing region whose shape and size are adapted to a particular dent configuration. The stressing region produces a concentrated electromagnetic field that is localized in the area of the dent. Several examples of work coils that produce localized electromagnetic fields are described in U.S. Pat. No. 4,061,007, entitled "Electromagnetid dent Remover with Electromagnetic Localized Work Coil", the disclosure of which is hereby incorporated by reference.

While electromagnetic dent removers of the type described in U.S. Pat. Nos. 3,998,081 and 4,061,007 have proven to be somewhat satisfactory, they are not as satisfactory as desirable. One problem with these prior art dent removers is that while they may be effective in removing dents from relatively rigid parts, they are substantially less effective in removing dents from flexible parts (or flexible portions of rigid parts). In a rigid part, the area around a dent is stabilized by the inherent rigidity of the part. As a result, the area adjacent the dent is minimally affected (if at all) by the forces exerted on the dent by the dent remover. The rigidity of the part permits the repelling force and the pulling force to be concentrated at the dent, which facilitates removal of the dent.

In flexible parts, such as the skin of an aircraft, flexibility of the skin actually hinders dent removal by the prior art dent removers. The skin, including the dent and the area adjacent to the dent may be temporarily flexed by the forces exerted on it by the dent remover. That is, the repelling force of the work coil may cause the skin to flex in the direction away from the work coil. When the pulling force is exerted on the part, the skin, including the dent and the area adjacent to the dent, is again flexed, this time in the direction of the work coil. This flexing of the skin causes the pulling force to be dissipated into the area of the part adjacent the dent. As a result, the strength of the pulling force exerted on the dent is reduced and the removal of the dent is made more difficult.

One approach used with the prior art dent removers to overcome the problem of removing dents in flexible parts, is to increase the pulling force exerted on the part. However, increasing the pulling force requires that the electromagnetic field that exerts the repelling force be increased, which causes further flexing of the part away from the work coil. Thus, some of the increased pulling force is dissipated into the area surrounding the dent when the part is flexed toward the work coil, thereby reducing the pulling force exerted on the dent.

Another approach used by the prior art dent removers is to mechanically stabilize the part by placing weights, such as sand bags, around the dent. The weights essentially "preflex" the part, so that it is not flexed away from the work coil by the repelling force of the work coil. Further, the weights prevent the part from being flexed toward the work coil by the pulling force. Thus, mechanically stabilizing the part in this way allows the pulling force to be concentrated at the dent. Unfortunately, this approach, while somewhat effective, is not very accurate. Shifting of the weights, or improper placement of the weights may allow some flexing of the part. Further, the labor associated with placement of the weights is rather costly. In some instances, the mere weight of the dent remover is sufficient to stabilize a flexible part. However, the weight of the dent remover may be overcome by the repelling pulling forces exerted by the work coil when very strong pulling forces are necessary to remove a dent.

As can be readily appreciated from the foregoing discussion, there is a need for an electromagnetic dent remover that is effective in removing dents from flexible parts or flexible areas of rigid parts. This invention is directed to a dent remover with a tapped work coil that exerts a stabilizing force concurrently with a pulling force to achieve these results.

SUMMARY OF THE INVENTION

In accordance with the present invention, an electromagnetic dent remover having a tapped work coil is provided. The dent remover includes an electric circuit and a dent removal head having a tapped work coil. The tapped work coil creates first and second coils. A power source produces a first pulse having a slow rise time. The first pulse is applied to the first and second coils and produces an electromagnetic field that exerts a repelling force. A predetermined period of time after the first current pulse is produced, the power source produces a second pulse having a polarity opposite that of the first pulse and a shorter rise time than that of the first pulse. The second pulse is applied to the second coil, which causes the electromagnetic field associated with the second coil to collapse and exert a pulling force. The power source is controlled by a control system. When positioned adjacent to a dented part, the pulling force exerted by the second coil acts to remove the dent while the repelling force exerted by the first coil acts to stabilize the dented part.

In accordance with further aspects of the present invention, a blocking inductor blocks the second pulse from the first coil. The blocking inductor includes the inductance of the first coil. The blocking inductor may also include a separate inductor that forms part of the control system.

In accordance with still further aspects of the present invention, the tapped work coil is a cylindrical electric coil having a plurality of substantially concentric winding. The first coil includes a plurality of outer windings and the second coil includes a plurality of inner windings inwardly spaced from the outer windings. The number of outer windings is less than the number of inner windings.

In accordance with alternative aspects of the present invention, the power source produces a third pulse having the same polarity as the first pulse and a shorter rise time than the first pulse. The third pulse is applied to the first coil and increases the repelling force associated with the first coil. The increased repelling force is used to further stabilize the dented part when increased pulling forces are required, or to remove convex deformations of a dent.

As will be appreciated from the foregoing summary, the invention provides an electromagnetic dent remover with a tapped work coil that stabilizes a dented part while concurrently removing a dent from the part.

BRIEF DESCRIPTION OF THE DRAWINGS

The foregoing and other features and advantages of the invention will become more readily appreciated as the same becomes further understood by reference to the following detailed description when taken in conjunction with the accompanying drawings, wherein.

DESCRIPTION OF THE PREFERRED EMBODIMENT

There has developed a need for an electromagnetic dent remover that will stabilize a flexible part so that a dent in the part can be readily removed by the dent remover. The present invention is directed to an electromagnetic dent remover with a tapped work coil designed to accomplish this result.

Figure 1:
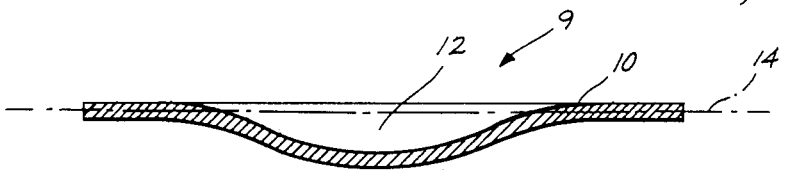
FIG. 1 is a sectional side view of a part having a concave dent.
Figure 2:
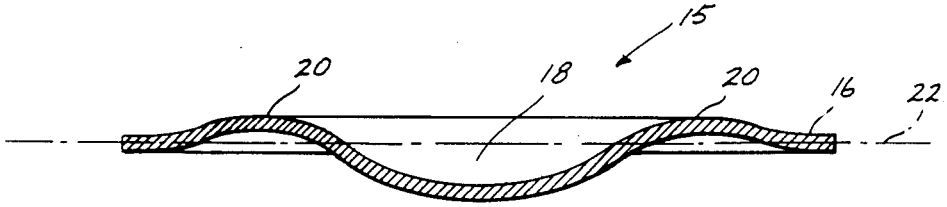
FIG. 2 is a sectional side view of a part with a dent having both concave and convex deformations.

FIGS. 1 and 2 illustrate two exemplary dent configurations that may be removed from a part by an electromagnetic dent remover in accordance with the present invention. FIG. 1 shows, in section, a part 9 made of conductive sheet material 10. The part 9 includes a dent in the form of a concave deformation 12. The original profile centerline of dented part 9 is denoted by dashed line 14. FIG. 2 shows, also in section, a part 15 made of conductive sheet material 16. The part 15 includes a dent in the form of convex deformations 20 partially or fully surrounding a concave deformation 18. The original profile centerline of dented part 15 is indicated by dashed line 22. The dents represented by the deformations depicted in FIGS. 1 and 2 are merely illustrative of the types of dents that may be removed by a dent remover formed in accordance with the present invention. As will become better understood from the following discussion, unlike the prior electromagnetic art dent removers, the dent remover of the present invention removes the dents from the parts 9 and 15 even if the parts are relatively flexible. An example of a flexible part is the skin of an aircraft and, more particularly, the skin of an aircraft at a location spaced from the stiffeners used to support the skin.

Figure 3:
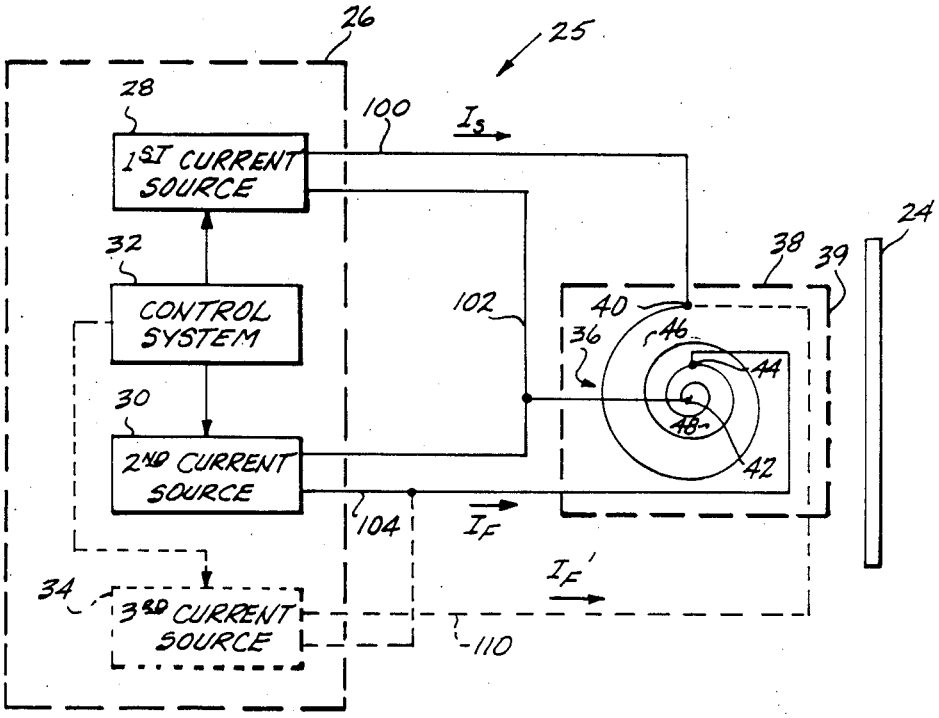
FIG. 3 is a partial block diagram and partial pictorial diagram of an electromagnetic dent remover having a tapped work coil formed in accordance with the present invention.

Turning now to the present invention, FIG. 3 illustrates an electromagnetic dent remover 25 comprising an electric circuit 26 and a dent removal head 38. A working surface 39 of the dent removal head 38 is shown located adjacent to a dented part 24. More specifically, when in operation, the working surface 39 is positioned over a dent (not shown) in the part 24. The dented part 24 is made of conductive material and may comprise one or more of the types of dents depicted in FIGS. 1 and 2 and noted above. The dent removal head 38 includes a tapped work coil 36. For the purpose of clarity, the taped work coil 36, in FIG. 3, is shown rotated 90° relative to the working surface 39 of the dent removal head. The tapped work coil 36, which will be described more fully below, is preferably a cylindrical electric coil having an outer portion, hereinafter referred to as an outer coil 46, and an inner portion, hereinafter referred to as an inner coil 48. One end of the outer coil 46 is connected to an outer terminal 40 and the other end is connected to intermediate terminal, or tap 44. Similarly, one end of the inner coil 48 is connected to an inner terminal 42 and the other end is connected to the tap 44.

The electric circuit 26 includes a first current source 28 and a second current source 30, which are controlled by a control system 32. A third current source 34, also controlled by the control system 32, is used in an alternative embodiment of the present invention and is discussed more fully below. Although they are shown separately in FIG. 3, the first current source 28, the second current source 30, and the third current source 34 may form part of a single power source.

Figures 4A, 4B, 4C, 4D, 4E, 4F:
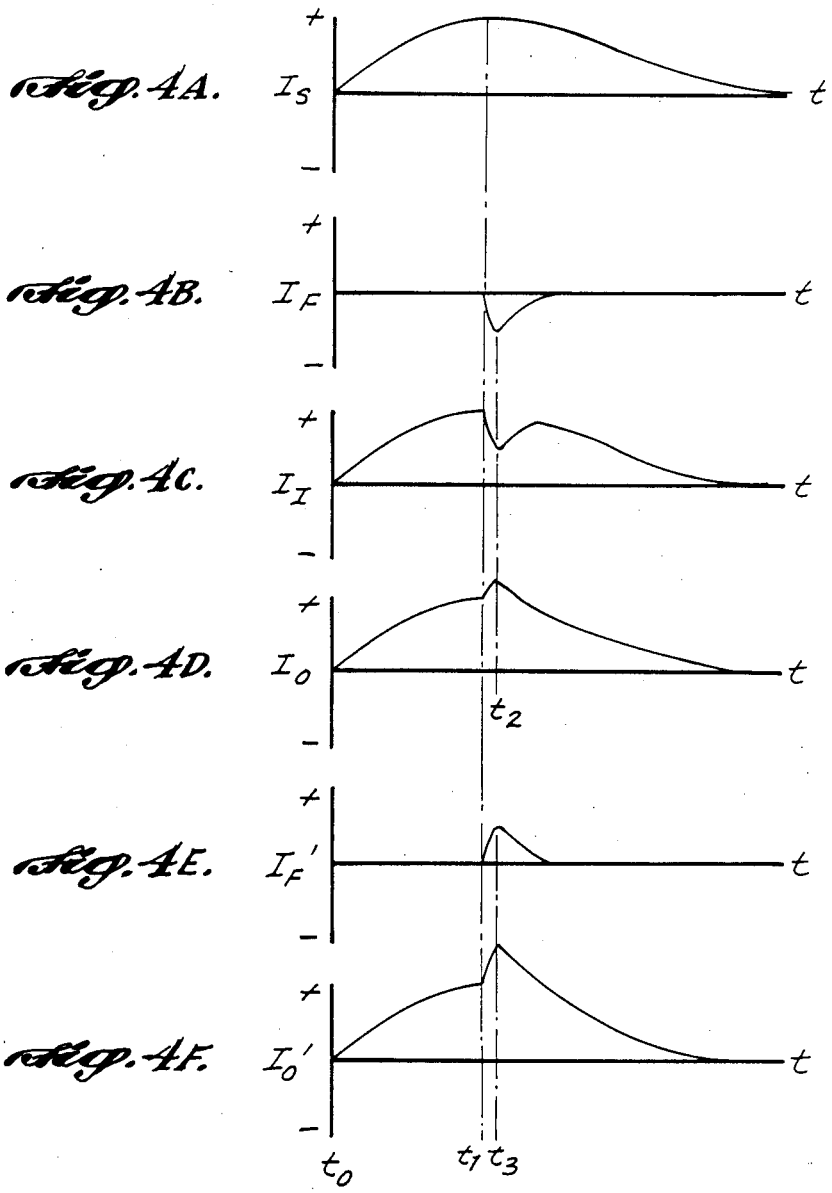
FIG. 4A through 4F are a series of waveforms depicting different current flows in the dent remover depicted in FIG. 3.

The control system 32 causes the first current source 28 to produce a current pulse, designated $I_S$, at some initial time, denoted $t_0$. The $I_S$ pulse is applied to the outer terminal 40 of the work coil 36 via line 100. The $I_S$ pulse passes through the outer and inner coils 46 and 48 and returns to the first current source 28 via line 102, which is connected to the inner terminal 42. For purposes of this discussion, the current flow in the outer and inner coils 46 and 48 are designated $I_O$ and $I_I$, respectively. Thus, prior to the introduction of additional current to the work coil 36, $I_O$ and $I_I$ replicate the $I_S$ current pulse. The shape of the $I_S$ current pulse is illustrated in FIG. 4A, where the time interval between $t_0$ and a subsequent time, denoted $t_1$, is the rise time of $I_S$. In accordance with the preferred embodiment of the invention, $I_S$ has a relatively slow rise time, such as 1.5 milliseconds, for example. The rise time of the $I_S$ pulse is determined, in part, by the impedance of the outer and inner coils 46 and 48. In a conventional manner, the $I_S$ current pulse causes the work coil 36 to produce an electromagnetic field that emanates from the working surface 39 of the work coil 38 and exerts a repelling force on an adjacent part 24. While the electromagnetic field penetrates the part 24, the relatively slow rise time of the $I_S$ pulse and, hence, relatively slow rise time of the electromagnetic field create a repelling force that is too weak to deform the part 24.

A predetermined period of time after the $I_S$ pulse is produced, the control system 32 causes the second current source 30 to produce a fast current pulse, designated $I_F$. In one physical embodiment of the dent remover 25 of the present invention, the $I_F$ pulse is produced approximately 1.5 ms after the $I_S$ pulse is produced. While this time period coincides with the rise time of the $I_S$ pulse in the above example, it is to be understood that the other time delays between the $I_S$ and $I_F$ pulses may be used with the dent remover 25 of the present invention. The $I_F$ pulse has a fast rise time relative to the slow rise time of the $I_S$ pulse. For example, in one actual embodiment of the invention, wherein the $I_S$ pulse has a rise time of 1.5 milliseconds, the $I_F$ pulse has a rise time of 10 microseconds. The rise time of the $I_F$ pulse is determined, in part, by the impedance of the inner coil 48. The polarity of the $I_F$ pulse is opposite the polarity of the $I_S$ pulse. The shape of the $I_F$ pulse is illustrated in FIG. 4B. An example of a dent remover that similarly uses fast and slow current pulses is described in U.S. Pat. No. 3,998,081, entitled "Electromagnetic Dent Puller", the disclosure of which is hereby incorporated by reference.

The $I_F$ pulse is applied to the tap 44 of the work coil 36 via line 104. The $I_F$ pulse passes through the inner coil 48 and returns to the second current source 30 via line 102. Since the $I_F$ pulse has a polarity opposite that of the $I_S$ pulse, the introduction of the $I_F$ pulse causes a rapid decrease in the magnitude of the $I_I$ current in the inner coil 48. The rapid decrease in the $I_I$ current (which begins at $t_1$) collapses a portion of the electromagnetic field produced by the inner coil 48. FIG. 4c illustrates the $I_I$ current flow and, thus, the combined $I_S$ and $I_F$ current flow. The rapidly collapsing electromagnetic field causes the repelling force exerted by the inner coil 48 to rapidly change. More specifically, the collapsing electromagnetic field causes the repelling force to change to a pulling force. Like the repelling force, the pulling force is exerted on the part 24. But, unlike the repelling force, the rapidly collapsing electromagnetic field produces a pulling force sufficiently strong to deform the part 24. At the same time that the electromagnetic field associated with inner coil 48 exerts the pulling force, the electromagnetic field associated with the outer coil 46 continues to exert the repelling force. When the tapped work coil 36 is properly positioned over a dent, the repelling force associated with the outer coil 46 stabilizes the part 24 while the pulling force created by the inner coil 48 deforms the part 24 and removes the dent.

The repelling force stabilizes the part 24 by, at least partially, counteracting the pulling effect of the pulling force in the area of the part 24 adjacent to the dent being pulled. More specifically, the repelling force exerted by the outer coil 46, prevents the area of the part 24 adjacent the dent from flexing due to the pulling force exerted by the inner coil 48 on the dent. This stabilizing effect of the repelling force makes the area of the flexible part around the dent more rigid. As is well known in the dent removal art, dents are more easily removed from rigid parts than from flexible parts. As a result, the electromagnetic dent remover 25 of the present invention is more effective than the prior art dent removers in removing dents from flexible parts, such as the skin of an aircraft.

As will become evident from the following discussion, the use of a tapped work coil 36 improves the efficiency of the dent remover 25 over that of the prior art dent removers. In the prior art dent removers, the slow and fast current pulses (such as $I_S$ and $I_F$ in the present invention) are applied to the entire work coil. This results in an impedance compromise between the type of coil needed to create the strong, penetrating electromagnetic field required to produce a repelling force and the type of coil needed to create the rapidly collapsing electromagnetic field required to produce a pulling force. As is well known, a coil with a relatively high impedance is needed to produce a strong, penetrating electromagnetic field. As is also well known, a coil with a relatively low impedance is needed to create a rapidly collapsing electromagnetic field. If coil impedance is too high, the electromagnetic field will not collapse rapidly. Contrariwise, if the coil impedance is too low, the electromagnetic field will not be strong enough to penetrate the part. Thus, a compromise in coil impedance must be made in the prior art dent removers, which requires larger values of the slow and fast current pulses than would be required if the coil impedance was not a compromised value.

As discussed above, the tapped work coil 36 of the electromagnetic dent remover 25 of the present invention includes two coils, namely, the outer and inner coils 46 and 48. The outer and inner coils 46 and 48 are series connected to form the tapped work coil 36. Accordingly, the total impedance of the work coil 36 is equal to the sum of the individual impedances of the outer and inner coils 46 and 48. In other words, the impedance of the inner coil 48 is less than the overall impedance of the tapped work coil 36. This allows the overall impedance of the tapped work coil 36 to be selected to provide a strong, penetrating electromagnetic field when $I_S$ is applied to the work coil 36. At the same time, the impedance of the inner coil 48, can be made low enough to allow the portion of the electromagnetic field created by the inner coil 48 to rapidly collapse when the $I_F$ current pulse is applied. As a result, lower current values are required to produce the necessary repelling and pulling forces, resulting in a more efficient electromagnetic dent remover.

As will become better understood from the following discussion, the introduction of the $I_F$ pulse causes a slight increase in the repelling force produced by the outer coil 46. When the $I_F$ pulse is applied to the inner coil 48, at time $t_1$, the $I_O$ current in the outer portion 46 increases slightly. See FIG. 4D. As with the $I_F$ pulse, the slight increase in the $I_O$ current, beginning at $t_1$, also has a fast rise time. This increase in the $I_O$ current causes the repelling force associated with the outer coil 46 to increase. The increased repelling force helps to stabilize the part 24, allowing a greater pulling force to be used to pull deep or otherwise difficult-to-remove dents. Further, the fast rise time of the increase in the $I_O$ current creates an increased repelling force that may be sufficiently strong to deform the part 24 and remove the convex portions of a dent that surround a concave portion, such as the convex deformations 20 depicted in FIG. 2 and discussed above.

As noted above, an alternative embodiment of the electric circuit 26 includes the third current source 34 whose operation is controlled by the control system 32. More specifically, at the same time that the control system 32 causes the second current source 30 to produce the $I_F$ pulse (i.e., at time $t_1$), the control system 32 also causes the third current source 34 to produce a fast current pulse, designated $I'_F$. Unlike the $I_F$ pulse, the $I'_F$ pulse has the same polarity as the $I_S$ pulse. The shape of the $I'_F$ pulse is illustrated in FIG. 4E. The rise time of the $I'_F$ pulse is defined by the time interval between $t_1$ and a subsequent time, $t_3$. Preferably the rise time of $I'_F$ is equal to the rise time of $I_F$ (e.g., 10 $\mu$s) but in any event, it is substantially shorter than the rise time of the $I_S$ pulse.

The $I'_F$ pulse is applied to the outer terminal 40 of the work coil 36 via line 110, flows through the outer coil 46, and returns to the third current source via line 104. Since the $I'_F$ pulse has the same polarity as the $I_S$ pulse, the $I'_F$ and $I_S$ pulses sum at the outer terminal 40 and cause a current, designated $I'_O$, to flow in the outer coil 46. The $I'_O$ current is illustrated in FIG. 4F. The $I'_F$ pulse causes an increase in the magnitude of the $I'_O$ current at time $t_1$. More specifically, the fast rise time of the $I'_F$ pulse causes the increase in the $I'_O$ current to also have a fast rise time. The increase in the $I'_O$ current causes the repelling force associated with the outer coil 46 to increase. The increased repelling force helps stabilize the part 24 when very high pulling forces are required to remove a dent. In addition, the fast rise time of the change in the $I'_O$ current allows the increased repelling force to be made sufficiently strong to remove convex portions of a dent (such as those shown in FIG. 2).

Figure 5:
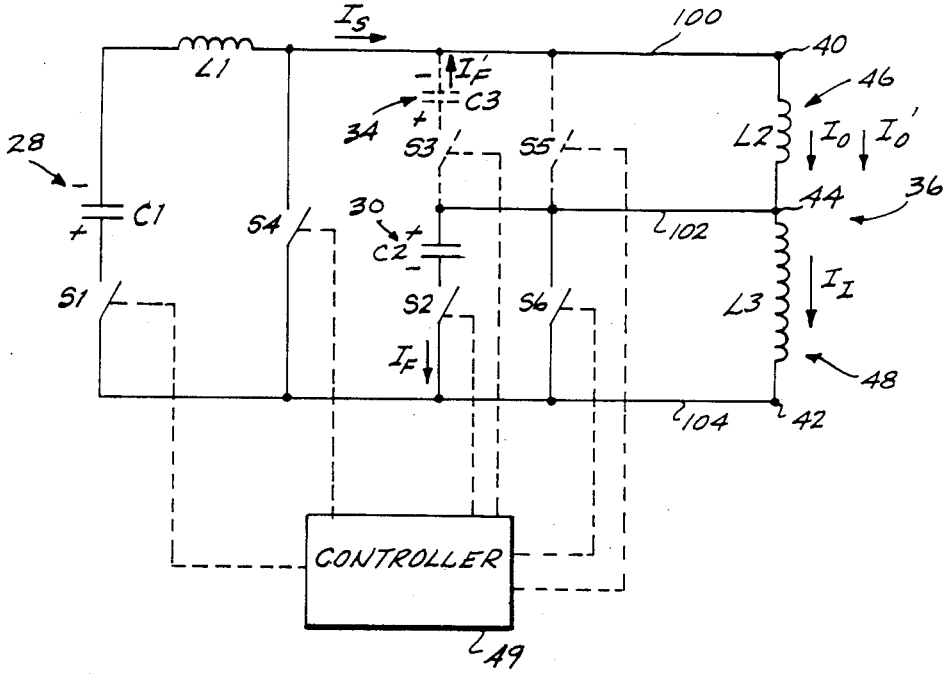
FIG. 5 is a simplified schematic diagram of a preferred embodiment of a portion of the dent remover depicted in FIG. 3.

FIG. 5 is a simplified schematic diagram of a portion of the preferred embodiment of the electromagnetic dent remover 25 depicted in FIG. 3 and discussed above. As illustrated in FIG. 5, the first current source 28 consists of a capacitor, or bank of capacitors, denoted C1. Similarly, the second current source 30 consists of a capacitor or bank of capacitors, denoted C2. The third current source 34, which, as noted above, is included in an alternative embodiment of the present invention, also consists of a capacitor or bank of capacitors, denoted C3.

A portion of the control system 32, also shown in the circuit of FIG. 5, includes an inductor, denoted L1; six switches, denoted S1, S2, S3, S4, S5, and S6; and, a controller 49 for controlling the opening and closing of the switches in the manner hereinafter described. Finally, the work coil 36 is depicted as two inductors, designated L2 and L3. L2 represents the outer coil 46 and L3 represents the inner coil 48.

One end of L2 is connected to one end of L3 at tap 44. The other end of L2 is connected to the outer terminal 40 and the other end of L3 is connected to the inner terminal 42. One side of C1 is connected to one end of L1. The other end of L1 is connected to L2 at the outer terminal 40 and to one side of S4. The other end of C1 is connected to one side of S1. The other side of S1 is connected to L3 at the inner terminal 42, the other side of S4, and to one side of S2 and S6. The other side of S2 is connected to one side of C2. The other side of C2 is connected to L2 and L3 at the tap 44 and to the other side of S6. If the third current source 34 is included, one side of S3 is connected to the tap 44 and one side of S5, the other side of S3 is connected to one side of C3, and the other side of C3 is connected to the other side of S5 and to L2 at the outer terminal 40. Outputs of the controller 49 are connected to the switches, S1–S6.

Initially, all of the switches, S1–S6, are open and the capacitor banks, C1 and C2 (and C3, if used) are charged by a power supply, which is not shown in FIG. 5, and have the polarities as indicated. At time $t_0$, S1 closes, which causes C1 to discharge and produce the $I_S$ current pulse (FIG. 4A). The $I_S$ pulse is applied to L1 and to L2 and L3 of the work coil 36. At time $t_1$, S4 closes, shorting out S1, C1, and L1 and causing the $I_S$ pulse to decay. At the same time (i.e., $t_1$), S2 closes, which causes C2 to discharge and produce the $I_F$ pulse. The $I_F$ pulse is applied to L3 of the work coil 36. At time $t_2$, which occurs a predetermined period of time after $t_1$, S6 closes, shorting out S2 and C2 and causing the $I_F$ pulse to decay.

L1 and L2 form a blocking inductor that prevents the flow of the $I_F$ current pulse. Accordingly, the $I_F$ current pulse is prevented from flowing through L2 (i.e., the outer portion 46 of the work coil 36) and through the first current source 28. If the inductance of L2 is large enough to block the $I_F$ current pulse, L1 may not be required. The resulting $I_O$ current in L2 (FIG. 4D) causes the outer coil 46 to exert the repelling force on the part 24, as noted above. The $I_I$ current in L3 (FIG. 4C), which is the difference between the $I_S$ and $I_F$ current pulses, causes the inner coil 48 to exert the pulling force on the part 24, as also noted above.

As indicated above, L1 and L2 block the $I_F$ pulse from the first current source 28 (i.e., C1) and from the outer coil 48 (i.e., L2). As will be appreciated by those skilled in this art, it is undesirable to have the $I_F$ pulse, or a portion thereof, in either the outer coil 46 or first current source 28. The $I_F$ pulse, if permitted to flow through the outer coil 46, would reduce the magnitude of the $I_O$ current and, hence, reduce the strength of the repelling force associated with the outer coil 46. The reduced repelling force may permit the part 24 to be flexed by the pulling force exerted by the inner coil 48. In any event, the stabilizing effect of the dent remover would be reduced, making removal of the dent more difficult. If the $I_F$ pulse is permitted to flow into the first current source 28, C1 would be charged by $I_F$ at the same time that C1 is discharging. As a result, C1 would discharge more slowly and the electromagnetic field associated with the inner coil 48 would collapse more slowly. Thus, the pulling force would be reduced, which would make dent removal more difficult.

In the alternative embodiment of the electromagnetic dent puller discussed above, the third current source 34 is used in the following manner. At time $t_1$, S3 closes, causing C3 to discharge and produce the $I'_F$ current pulse (FIG. 4E). At time $t_3$, which occurs some predetermined period of time after $t_1$, S5 closes, causing the $I'_F$ pulse to decay. Preferably, $t_2$ and $t_3$ occur at the same time. The $I'_F$ current pulse is summed with the $I_S$ pulse at the outer terminal 40 to rapidly produce the $I'_O$ current in L2 (FIG. 4F). As noted above, since the $I'_F$ current rapidly increases the current flow through L2, the strength of the repelling force exerted by the outer coil 46 is also increased. As also noted above, the increased strength of the repelling force is used to help stabilize the part 24 (not shown in FIG. 5) when increased pulling forces are required or to remove the convex portions of a dent of the type depicted in FIG. 2.

As is apparent from the foregoing discussion, the switches, S1, S2, S3, S4, S5 and S6 and the controller 49, control the production of the current pulses produced by the electromagnetic dent puller 25 of the present invention. More specifically, the timing of the closure of S1, S2 and S3 determines when the current pulses are produced. S1, S2 and S3 also provide a means for connecting the current sources 28, 30 and 34 to the work coil 36. Similarly, the closure of S4, S5 and S6 determines when the current pulses begin to decay.

The power supply (not shown) may be a charging circuit that forms a part of the control system 32. After S4, S5 and S6 have closed, and after a sufficient time to permit C1, C2, and C3 to discharge, the S1, S2, and S3 switches open and the power supply charges C1, C2, and C3 for use during the next dent pulling operation.

Figure 6:
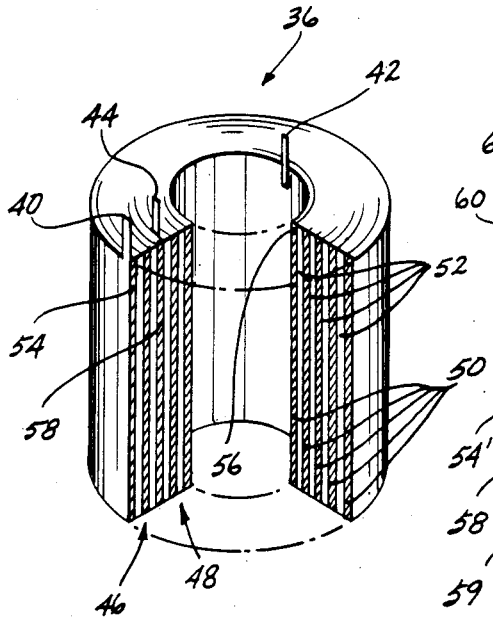
FIG. 6 is a partially cut-away, isometric view of a preferred embodiment of a tapped work coil suitable for use in the dent remover depicted in FIG. 3; and, FIG. 7 is a partially cut-away, isometric view of an alternative embodiment of a tapped work coil suitable for use in a dent remover formed in accordance with the present invention.

FIG. 6 illustrates a preferred embodiment of the work coil 36. As noted above, and further illustrated in FIG. 6, the work coil 36 is preferably a cylindrical electric coil. In this preferred embodiment, the work coil 36 comprises a flat conductor 50 and an insulating layer 52 spirally wound in alternating layers. The work coil 36 may include stressing regions (not shown) to control the electromagnetic field produced by the coil 36. As noted above, such an electromagnetic coil is disclosed in U.S. Pat. No. 4,061,007, entitled "Electromagnetic Dent Remover with Electromagnetic Localized Work Coil," the disclosure of which is hereby incorporated by reference. The stressing regions localize the electromagnetic field produced by the work coil 36 so that the pulling force can be localized at the dent to be removed.

The outer terminal 40, the inner terminal 42, and the tap 44, are electrically connected to the conductor 50 and are preferably in the form of a post or tab-like structure. The outer terminal 40 is connected to an outermost winding 54 of the conductor 50. The inner terminal 42 is connected to an innermost winding 56 of the conductor 50. Similarly, the tap 44 is connected to an intermediate winding 58 of the conductor 50. Accordingly, the outer coil 46 of the work coil 36 is formed by a plurality of windings of the conductor 50 between the outer terminal 40 and the tap 44. Similarly, the inner coil 48 of the work coil 36 is formed by a plurality of windings of the conductor 50 between the inner terminal 42 and the tap 44. In accordance with the preferred embodiment, the number of windings in the outer coil 46 is less than the number of windings in the inner coil 48. More specifically, and in accordance with one physical embodiment of the present invention, the number of windings in the outer coil 46 is less than 50% of the windings in the inner coil 48.

Figure 7:
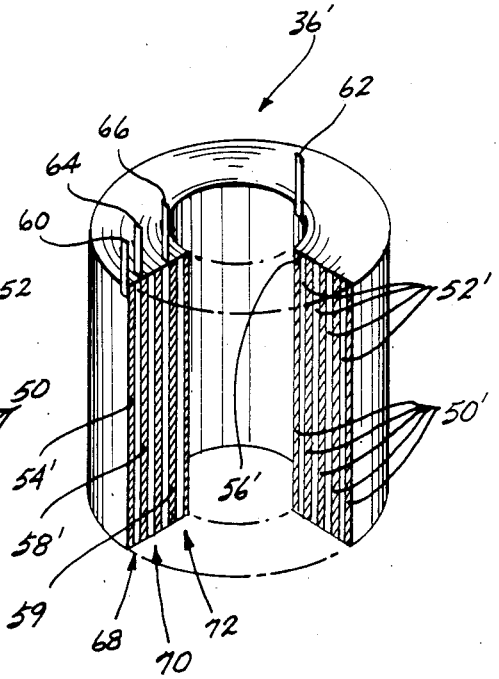

FIG. 7 illustrates an alternative embodiment of a tapped work coil 36' suitable for use in accordance with the present invention. The work coil 36' is a cylindrical electric coil having alternating layers of a spirally wound flat conductor 50' and insulating layer 52'. An outer terminal 60 and an inner terminal 62 are connected to an outermost and an innermost winding 54' and 56', respectively. A first tap 64 is connected to one intermediate winding 58'. A second tap 66 is connected to another intermediate winding 59. In the alternative embodiment of the work coil depicted in FIG. 7, a plurality of windings of the conductor 50', which are defined at either end by the terminals 64 and 66, form an intermediate annular coil 70. Similarly, a plurality of windings defined on either end by terminals 60 and 64 and by 62 and 66 forms an outer annular coil 68 and an inner annular coil 72, respectively. In accordance with this alternative embodiment of the present invention, the $I_S$ current pulse (and the $I'_F$ current pulse) is applied to the work coil 36' via terminals 60 and 62 and the $I_F$ current pulse is applied to the work coil 36' via terminals 64 and 66. Accordingly, a repelling force is exerted by electromagnetic fields produced by the outer and inner annular coils 68 and 72 and a pulling force is exerted by an electromagnetic field produced by the intermediate annular coil 70. Obviously, FIGS. 6 and 7 are merely illustrative of numerous configurations of a tapped work coil suitable for use in the electromagnetic dent remover of the present invention.

As can be readily appreciated from the foregoing description, the invention provides an electromagnetic dent remover that uses a tapped work coil to stablilize a dented part while simultaneously removing the dent. While preferred embodiments of the invention have been illustrated and described herein, it is to be understood, that within the scope of the appended claims, various changes can be made. Instead of a cylindrical electrical coil, the work coil may be of a pancake or other suitable design. If the inductance of the outer portion of the work coil is sufficiently large, the blocking inductance of the control system may be eliminated. Further, the switches can be high voltage semiconductor switches rather than mechanical switches. Hence, within the scope of the appended claims, it is to be understood that the invention can be practiced otherwise than as specifically described herein.

The embodiments of the invention in which an exclusive property or privilege is claimed are defined as follows:

1. An electromagnetic dent remover for electromagnetically removing dents from conductive materials comprising:

(a) power source means for producing: a first pulse, said first pulse having a predetermined polarity and rise time; and, a second pulse, said second pulse having a polarity opposite to said predetermined polarity of said first pulse and a rise time shorter than said rise time of said first pulse;

(b) a dent removal head including an electric coil having an electromagnetic stabilizing section coupled to said power source means for receiving said first pulse and stabilizing a conductive part and an electromagnetic dent removal section coupled to said power source means for receiving said second pulse, and removing a dent from the conductive part; and, (c) control means coupled to said power supply means for causing said power supply means to apply said first pulse to said electromagnetic stabilizing section of said electric coil at a first time and said second pulse to said electric coil at said second time subsequent to said first time.

2. The dent remover claimed in claim 1, wherein said electric coil is an electric coil tapped to create a first coil and a second coil, said electromagnetic stabilizing section being formed by said first coil and said dent removing section being formed by said second coil.

3. The dent remover claimed in claim 2, wherein said power source means comprises:

(a) a first current source for producing said first pulse; and, (b) a second current source for producing said second pulse.

4. The dent remover claimed in claim 3, wherein said first current source includes a first capacitor bank and said second current source includes a second capacitor bank.

5. The dent puller claimed in claim 4, wherein said control means further comprises current blocking means for blocking said second current pulse from said first current source and from said first coil.

6. The dent remover claimed in claim 5, wherein said first coil of said tapped electric coil forms said current blocking means as well as part of said electromagnetic stabilizing section.

7. The dent remover claimed in claim 6, wherein said current blocking means further comprises an inductor.

8. The dent remover claimed in claim 2, wherein said first pulse causes said first coil and said second coil to produce an electromagnetic field adequate to penetrate a conductive part and exert a repelling force on the conductive part and, wherein said second pulse causes said electromagnetic field produced by said second coil to collapse and exert a pulling force on the conductive part, said repelling force produced by said first coil being adequate to stabilize the conductive part and said pulling force produced by said second coil being adequate to remove a dent from the conductive part.

9. The dent remover claimed in claim 8, wherein said tapped electric coil is a cylindrical electric coil having a plurality of substantially concentric windings.

10. The dent remover claimed in claim 9, wherein said first coil comprises a first plurality of said substantially concentric windings and said second coil comprises a second plurality of said substantially concentric windings.

11. The dent remover claimed in claim 10, wherein said first plurality of said substantially concentric windings is a plurality of outer windings and said second plurality of said substantially concentric windings is a plurality of inner windings, said plurality of inner windings being inwardly spaced from said plurality of outer windings.

12. The dent remover claimed in claim 11, wherein the number of said plurality of outer windings is less than the number of said plurality of inner windings.

13. The dent remover claimed in claim 12, wherein the number of said plurality of outer windings is less than 50% of the number of said plurality of inner windings.

14. The dent remover claimed in claim 13, wherein said tapped electric coil is an electromagnetic localized work coil having stressing regions for localizing the repelling and pulling forces exerted by said electromagnetic fields produced by said first and second coils.

15. The dent remover claimed in claim 8, wherein said dent removing means further comprises said first coil and wherein said repelling force produced by said first coil is strong enough to remove deformations from a dent that are convex with respect to said dent removal head.

16. The dent remover claimed in claim 15, wherein power source means further produces a third pulse, said third pulse having a polarity that is the same as the polarity of said first pulse and a rise time shorter than said rise time of said first pulse and, wherein said control means includes means for applying said third pulse to said first coil of said tapped electric coil at said second time.

17. The dent remover claimed in claim 16, wherein said rise time of said third pulse is substantially the same as said rise time of said second pulse.

18. The dent remover claimed in claim 17, wherein said power source means comprises:

(a) a first current source for producing said first pulse;

(b) a second current source for producing said second pulse; and, (c) a third current source for producing said third pulse.

19. The dent remover claimed in claim 18, wherein said first current source includes a first capacitor bank, said second current source includes a second capacitor bank, and said third current source includes a third capacitor bank.

20. In an electromagnetic dent remover having a work coil, a power source for producing a pulse, a control system for controlling the power source and applying the pulse to the work coil to produce an electromagnetic field for removing a dent from a conductive part, the improvement comprising a tapped work coil that includes:

(a) a stabilizing section coupled to the power source for stabilizing the conductive part; and, (b) a dent removal section coupled to the power source for removing the dent from the conductive part.

21. The improved electromagnetic dent remover claimed in claim 20, wherein said tapped work coil is a cylindrical electrical coil comprising a plurality of substantially concentric windings.

22. The improved electromagnetic dent remover claimed in claim 21, wherein said stabilizing section comprises a first coil formed by a first plurality of said concentric windings; and, said dent removing section comprises a second coil formed by a second plurality of said concentric windings.

23. The tapped work coil claimed in claim 22, wherein said first plurality of said substantially concentric windings forming said first coil is a plurality of outer windings and said second plurality of said substantially concentric windings forming said second coil is a plurality of inner windings inwardly spaced from said plurality of outer windings.

24. The tapped work coil claimed in claim 23, wherein the number of said first plurality of concentric windings forming said first coil is fewer than the number of said second plurality of concentric windings forming said second coil.

25. The tapped work coil claimed in claim 24, wherein the number of said first plurality of said concentric windings forming said first coil is less than 50% of the number of said second plurality of said concentric windings forming said second coil.

26. The tapped work coil claimed in claim 23, wherein said cylindrical electrical coil is an electromagnetic localized work coil having stressing regions for localizing the first and second electromagnetic fields produced by the first and second coils.

* * * * *

UNITED STATES PATENT AND TRADEMARK OFFICE

CERTIFICATE OF CORRECTION

PATENT NO. : 4,986,102

DATED : January 22, 1991

INVENTOR(S) : I. G. Hendrickson et al.

It is certified that error appears in the above-identified patent and that said Letters Patent is hereby corrected as shown below:

| Column | Line | |
|---|---|---|
| 2 | 59 | After "repelling" insert --and--. |

Signed and Sealed this

Twenty-eighth Day of July, 1992

*Attest:*

*Attesting Officer*

DOUGLAS B. COMER

*Acting Commissioner of Patents and Trademarks*